United States Patent [19]

Colvin

[11] Patent Number: 4,485,700

[45] Date of Patent: Dec. 4, 1984

[54] REVERSIBLE RATCHET WRENCH

[76] Inventor: David S. Colvin, 23933 Haynes, Farmington Hills, Mich. 48018

[21] Appl. No.: 461,242

[22] Filed: Jan. 26, 1983

[51] Int. Cl.[3] ..... B25B 13/46

[52] U.S. Cl. ..... 81/62; 81/63

[58] Field of Search ..... 81/60–63, 81/58.1

[56] References Cited

U.S. PATENT DOCUMENTS

| | | | |
|---|---|---|---|
| Re. 23,661 | 5/1949 | Able et al. . | |
| 376,584 | 1/1888 | Cone | 81/58.1 |
| 1,138,276 | 5/1915 | Carll . | |
| 1,140,167 | 5/1915 | Kolb et al. . | |
| 1,147,476 | 7/1915 | Alston et al. . | |
| 1,854,513 | 4/1932 | Hummel . | |
| 1,868,839 | 7/1932 | McNaught et al. . | |
| 1,957,462 | 5/1934 | Kress . | |
| 2,542,241 | 2/1951 | Fors | 81/63 |
| 2,658,416 | 10/1953 | Duerksen . | |
| 2,680,983 | 6/1954 | Miller . | |
| 2,686,446 | 4/1952 | Livermont . | |
| 2,701,977 | 2/1955 | Stone | 81/63.2 |
| 2,720,127 | 10/1955 | Bonniwell . | |
| 2,725,772 | 12/1955 | Stone . | |
| 2,891,434 | 6/1959 | Lozensky . | |
| 2,943,523 | 7/1960 | Gray et al. . | |
| 2,957,377 | 10/1960 | Hare . | |
| 2,978,081 | 4/1961 | Ludin . | |
| 2,982,160 | 5/1961 | Little . | |
| 3,096,659 | 7/1963 | Jenkins . | |
| 3,140,625 | 7/1964 | Pannozzo . | |
| 3,145,594 | 8/1964 | Peters . | |
| 3,233,481 | 2/1966 | Bacon . | |
| 3,299,725 | 1/1967 | Gewirc et al. . | |
| 3,369,416 | 2/1968 | Kilness . | |
| 3,448,641 | 6/1969 | Morrow . | |
| 3,490,317 | 1/1970 | Rozmus . | |
| 3,724,298 | 4/1973 | Howard . | |
| 3,754,486 | 8/1973 | Mariner . | |
| 3,967,514 | 7/1976 | Deutch . | |
| 4,147,076 | 4/1979 | Wright et al. . | |
| 4,274,311 | 6/1981 | Ebert . | |
| 4,277,990 | 7/1981 | Hall . | |
| 4,300,413 | 11/1981 | Garogalo . | |
| 4,308,769 | 1/1982 | Rantanen . | |
| 4,324,158 | 4/1982 | Le Roy . | |
| 4,328,720 | 5/1982 | Shiel . | |
| 4,336,728 | 6/1982 | Deibert . | |

FOREIGN PATENT DOCUMENTS

| | | |
|---|---|---|
| 1029033 | 5/1953 | France . |

*Primary Examiner*—James L. Jones, Jr.

*Attorney, Agent, or Firm*—Brooks & Kushman

[57] ABSTRACT

A reversible ratchet wrench (10) includes a wrench body (11) having a unitary head (12) including an opening (20) with circular driver and pawl portions (22,24). A driver (26) has a ratchet portion (28) received within the driver portion (22) of the opening and includes ratchet teeth (30) that extend between oppositely facing planar surfaces (16,18) of the wrench head (12). A pawl (38) is received within the pawl portion (24) of the opening (20) and includes teeth (**40*a*,40*b*) that extend between the planar wrench heat surfaces (16,18) and provide continuous uninterrupted engagement therebetween for selective locking of the driver in one direction and ratcheting in the other direction. Driver and pawl portions (22, 24) of the wrench head opening (20) have cylindrical shapes which facilitate manufacturing and the support of both the driver and the pawl upon assembling. A tab (42) of pawl (38) is provided for changing the direction of locking, and a spring biaser (44) operates on the pawl to provide a means for maintaining the pawl teeth (40*a* or 40*b*) in engagement with the ratchet teeth (30**) on the driver in order to provide locking in one direction and ratcheting in the other direction.

17 Claims, 6 Drawing Figures

REVERSIBLE RATCHET WRENCH

TECHNICAL FIELD

This invention relates to a reversible ratchet wrench used to selectively apply torque in opposite directions to either tighten or loosen a nut or a bolt head.

BACKGROUND ART

Reversible ratchet wrenches are utilized to selectively apply torque in either direction to tighten or loosen a nut or a bolt head. A head of the wrench conventionally includes a driving lug that is connected to a socket which engages the nut or bolt head. Application of a force to a handle of the wrench pivots the head to rotatively drive the socket in one direction, while application of a force in the opposite direction produces a ratcheting that permits the torquing to be performed in a stroking manner without disengagement of the socket from the nut or bolt head.

Conventional reversible ratchet wrenches include a rotatable driver on which the driving lug is provided to drive the socket. A pawl mounted on the head engages teeth of the driver to prevent rotation of the driver in one direction while permitting rotation thereof in the other direction by a ratcheting operation. Conventionally the driver and the pawl include teeth that are located between spaced portions of the wrench such that the teeth do not extend the full extent between oppositely facing surfaces of the head. It is possible to provide the teeth with greater lengths in order to increase the torque which can be applied through the pawl and driver teeth, but such an increase is limited by the fact that the head cannot be made too large or it will not be able to fit into confined locations.

Most reversible ratchet wrenches have a pawl which is mounted by a pin for pivotal movement to provide the selective locking thereof against rotation in one direction and ratcheting thereof in the other direction. However, such pawls have also previously been slidably mounted on a slideway such that rectilinear pawl movement reverses the directions in which the locking and ratcheting take place.

Conventional reversible ratchet wrenches are usually somewhat complex and require a head having a counterbored opening with annular recesses in order to receive and rotatably support the driver with the driving lug thereof projecting outwardly from the head. Such counterbored and recessed openings are relatively expensive to machine and thus add to the cost of the wrench.

Reversible ratchet wrenches of the type discussed above and other similar wrenches are disclosed by U.S. Pat. Nos. 2,686,446; 2,701,977; 2,720,127; 2,725,772; 2,943,523; 2,957,377; 2,978,081; 3,096,659; 3,140,625; 3,145,594; 3,233,481; 3,369,416; 3,724,298; 3,754,486; 3,967,514; and 4,147,076.

DISCLOSURE OF INVENTION

An object of the present invention is to provide an improved reversible ratchet wrench which has an uncomplicated construction so as to be economical to manufacture while still being of high strength and effective in use.

In carrying out the above object, the reversible ratchet wrench includes a unitary head and a handle extending from the head to permit the application of torque during use. The head has oppositely facing surfaces and includes an opening that extends between the surfaces. Circular driver and pawl portions of the opening overlap each other a slight extent and respectively receive a driver having a round ratchet portion and a generally circular pawl. The driver and pawl are respectively supported within the driver and pawl portions of the opening for rotation about driving and pawl axes; teeth on the round ratchet portion of the driver and on the pawl are enagagable to prevent rotation of the driver with respect to the head in one direction or the other depending upon the pawl position. A driving portion is provided on the driver and is disclosed as a lug that projects outwardly from the head along the driving axis to provide rotational connection to a socket that is driven by the wrench. A tab on the pawl permits rotation thereof about the pawl axis to change the direction of locking the driver against rotation. Engagement of the pawl teeth with the ratchet teeth on the driver is provided by a spring biaser that provides a preferred means for preventing rotation of the driver in one direction or the other while permitting rotation of the driver in the opposite direction by ratcheting of the pawl.

In accordance with one feature of the invention, both the teeth on the ratchet portion of the driver and the teeth on the pawl extend between oppositely facing planar surfaces of the unitary head to provide continuous uninterrupted engagement of the teeth between the surfaces. Such continuous uninterrupted engagement of the teeth for the full distance between the oppositely planar facing surfaces of the head permits the wrench to carry a large amount of torque while still having a relatively thin construction. This construction of the ratchet head allows it to operate in confined spaces and also allows the ratchet wrench to be manufactured with less material than conventional ratchet wrenches and at far less cost.

In accordance with another feature of the invention, the reversible ratchet wrench has the circular driver and pawl portions of the opening provided with cylindrical shapes extending between the oppositely facing planar surfaces of the head. A pair of planar retaining surfaces on the driver engage the oppositely facing planar surfaces of the head and also directly engage oppositely facing planar surfaces of the pawl to maintain the driver and the pawl rotatably supported on the head within the associated portions of the opening. This construction of the wrench provides an uncomplicated but effective and economical way for mounting of the driver and the pawl on the head.

In the preferred construction of the wrench, the head of the wrench body and the handle of the wrench are made unitary with each other in any suitable manner, most preferably by stamping which is a process that cannot be used to make conventional ratchet wrenches. The driver portion of the opening through the head has a larger size than the pawl portion of the opening and is located distally on the head from the handle. The pawl and the tab that rotates the pawl also have a unitary construction and can be made in any suitable manner.

In its preferred construction, the pawl includes a pair of positioning surfaces that are defined by a pair of notches against which the spring biaser acts to provide overcenter positioning of the pawl for locking of the driver in either direction. Spaced skirts of the pawl are positioned with the positioning surfaces located therebetween and hidden from sight. Each of the notches has a V shape such that the positioning surface defined thereby opens away from the pawl axis toward the spring biaser.

In its preferred construction, the spring biaser includes a ball and a spring that biases the ball against the positioning surfaces of the pawl to provide the overcenter positioning of the pawl. A hole is preferably provided in the head of the wrench body extending from the pawl portion of the opening toward the handle. The spring of the biaser is preferably of the helical type and has one end seated by the hole and another end that seats the ball to provide the biasing of the ball toward the pawl for the overcenter positioning of the pawl.

The driver also preferably includes a flange having one planar retaining surface that engages one planar surface of the head as well as engaging one planar surface of the pawl. A retainer on the driver has another planar retaining surface that engages the other planar surface of the head as well as engaging the other planar surface of the pawl. Cooperation of the driver flange and the retainer retains both the driver and the pawl on the head within the associated portions of the opening for reversible ratcheting operation.

The objects, features, and advantages of the present invention are readily apparent from the following detailed description of the best mode for carrying out the invention when taken in connection with accompanying drawings.

BEST MODE FOR CARRYING OUT THE INVENTION

Figure 1:
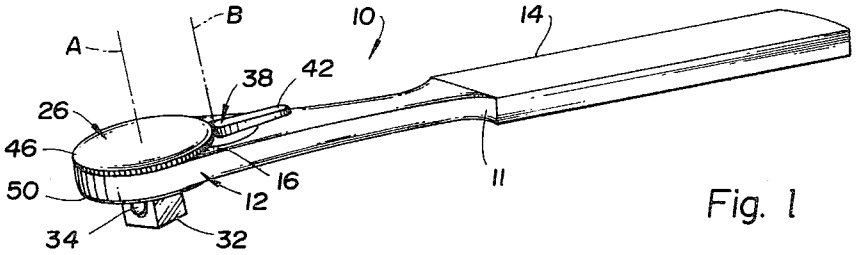
FIG. 1 is a perspective view of a reversible ratchet wrench that is constructed in accordance with the present invention.
Figure 2:
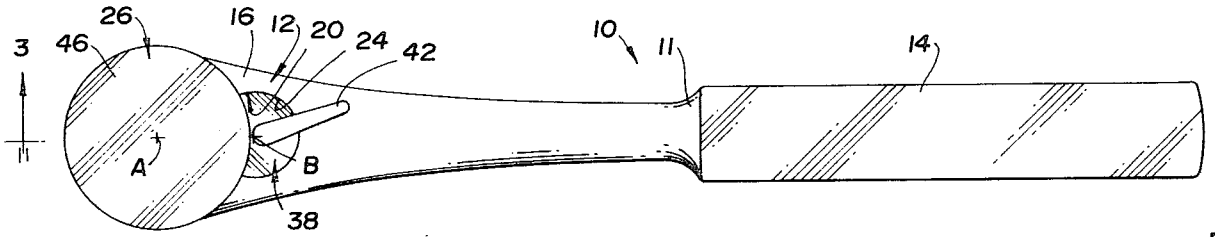
FIG. 2 is a plan view of the wrench.
Figure 3:
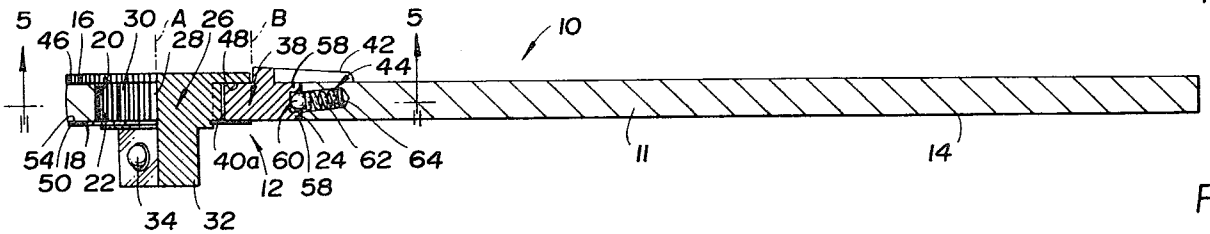
FIG. 3 is a longitudinal sectional view of the wrench taken along the direction of line 3—3 in FIG. 2.
Figure 4:
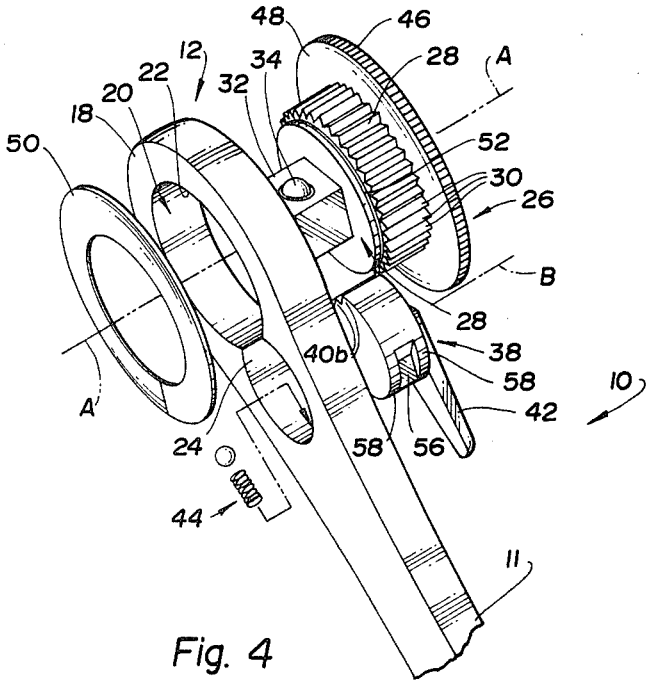
FIG. 4 is an exploded perspective view that illustrates the construction of a head of the wrench.

With reference to FIGS. 1 and 2 of the drawings, a reversible ratchet wrench constructed in accordance with the present invention is generally indicated by 10 and includes a wrench body 11 having a unitary head 12 and a handle 14 that extends from the head to permit the application of a manual force during use of the wrench. Wrench head 12 has oppositely planar facing surfaces 16 and 18 which extend parallel to each other as seen in FIG. 3. An opening 20 of the wrench head is illustrated in FIGS. 4 through 6 and includes circular driver and pawl portions 22 and 24 that overlap each other a slight extent.

Figure 5:
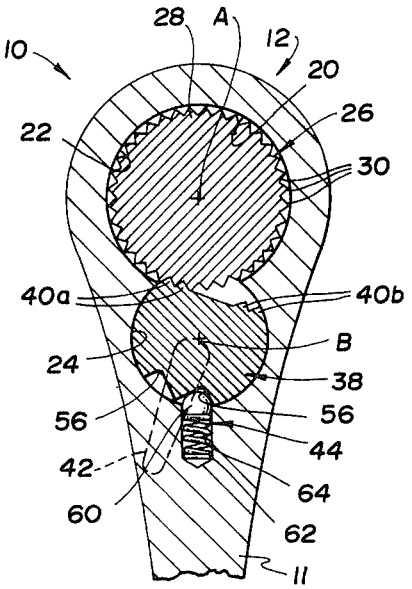
FIG. 5 is a sectional view taken along the direction of line 5—5 in FIG. 3 and illustrates the wrench locked against rotation in one direction but free to ratchet in the other direction.
Figure 6:
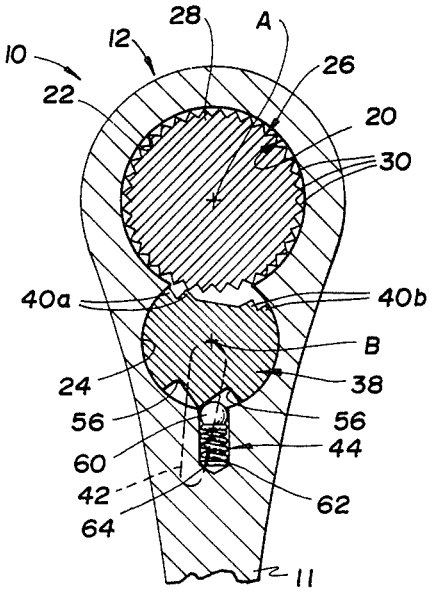
FIG. 6 is view similar to FIG. 5 but illustrating the wrench as ratcheting operation takes place.

A driver 26 of the wrench has a round ratchet portion 28 that is received within the circular driver portion 22 of the opening 20 as illustrated in FIGS. 5 and 6 so as to be supported for rotation about a driving axis A. Teeth 30 of the driver ratchet portion 28 are spaced about the axis A about which the driver rotates. A driving portion of driver 26 is embodied by a lug 32 that projects along axis A as illustrated in FIGS. 3 and 4 to provide connection of the driver to a socket with which the wrench is used to tighten or loosen a nut or a bolt head. Driving lug 32 preferably includes a spring biased ball detent 34 that is utilized to secure the socket to the driving lug. It should be appreciated that constructions other than the lug construction of the driving portion can be used such as, for example, an opening for receiving a separable driving member.

A generally round pawl 38 of the wrench is received within the pawl portion 24 of the opening 20 and as illustrated in FIGS. 5 and 6 and is supported for rotation about a pawl axis B that is spaced from the driver axis A extending in a parallel relationship. Pawl 38 has oppositely facing planar surfaces and includes spaced teeth 40*a* and 40*b* that are selectively engaged with the teeth 30 of the ratcher portion 28 of driver 26 in order prevent rotation of the driver with respect to the head 12 in one direction or the other depending upon the position of the pawl. A tab 42 of the pawl 38 is engaged by the thumb of the wrench operator to rotate the pawl about axis B and thereby engage either the pawl teeth 40*a* or 40*b* with the ratchet teeth 30 in order to change the direction of locking of the driver against rotation. A spring biaser 44 operates on the pawl 38 in a manner which is hereinafter more fully described to provide a preferrred means for maintaining the pawl teeth 40*a* or 40*b* in engagement with the teeth 30 on the driver to prevent rotation thereof in one direction or the other while permitting rotation of the driver in the opposite direction by ratcheting of the pawl.

As best illustrated in FIG. 3, both the ratchet teeth 30 and the pawl teeth 40*a,b* extend continously without interruption between the oppositely facing surfaces 16 and 18 of the wrench head 12 and have continuous uninterrupted engagement between these surfaces with the pawl 38 positioned to provide locking of the driver against rotation in one direction and ratcheting thereof in the other direction. This permits the wrench to carry a relatively large amount of torque while still having a thin construction that can be used in confined spaces. In addition, the ratchet wrench can be manufactured with less material than conventional ratchet wrenches and at far less cost.

As also illustrated in FIG. 3 and in FIG. 4 as well, the circular driver and pawl portions 22 and 24 of head opening 20 have cylindrical shapes extending between the oppositely planar facing surfaces 16 and 18 of the wrench head 12. This construction allows the opening 20 to be easily manufactured by a stamping operation and also has particular utility in providing the support for the ratchet and pawl teeth that extend between the oppositely facing surfaces of the head with continuous engagement therebetween in the locked condition.

With reference to FIG. 5, the wrench 10 is illustrated with the pawl teeth 40*a* engaged with the ratched teeth 30 to prevent rotation of the driver 26 in a counterclockwise direction with respect to the wrench head 12. Movement of the driver 26 in a clockwise direction with respect to wrench head 12 is then permitted by ratcheting of the pawl teeth 40*a* over the teeth 30 as shown in FIG. 6. Spring biaser 44 deflects to permit pawl movement that allows the ratcheting. Such ratcheting permits reciprocal stroking of the wrench handle 14 without disengagement of the associated socket from the nut or bolt head being rotated.

Pawl tab 42 is movable to the position illustrated to FIG. 6 to initially disengage the pawl teeth 40*a* from the ratchet 30 and to subsequently engage the pawl teeth 40*b* with the ratchet teeth in order to prevent clockwise rotation of the driver 26 with respect to the wrench head 12 and to permit ratcheting in the counterclockwise direction.

Driver 26 includes a flange 46 that has a planar retaining surface 48 for engaging the one planar surface 16 of the wrench head 12 as shown in FIG. 3. A retainer 50 of the driver is of the split ring type and is received by an annular groove 52 (FIG. 4) of the driver 26, and the retainer has a planar retaining surface 54 that engages the other planar surface 18 of the wrench head 12 as shown in FIG. 3 so as to cooperate with the flange surface 48 in retaining the ratchet portion 28 of the driver 26 within the driver portion 22 of the opening 20 in the wrench head. The planar flange retaining surface 48 and the planar retaining surface 54 of the retainer also directly engage the oppositely facing surfaces of pawl 38 to cooperate in retaining the pawl within the pawl portion 24 of the opening 20 in the wrench head. In the assembled condition, the driving lug 32 projects along the driver axis A outwardly past the wrench head surface 18 engaged by the retaining surface 54 of retainer 50.

In the preferred construction, the head 12 and handle 14 of wrench body 11 are made unitary with each other by a stamping operation. The driver portion 22 of the head opening 20 has a larger size than the pawl portion 24 of the opening as shown in FIGS. 4 through 6 and is located in a distal direction from the unitary handle 14 illustrated in FIGS. 1 through 3. Pawl 38 and its operating tab 42 are also preferably made with a unitary construction in any suitable manner.

As seen in FIGS. 5 and 6, the pawl 38 includes a pair of notches that define positioning surfaces 56 against which the spring biaser 44 acts to provide overcenter positioning of the pawl that engages either the pawl teeth 40*a* or 40*b* with the ratchet teeth 30. As seen in FIGS. 3 and 4, pawl 38 has spaced skirts 58 between which the positioning surfaces 56 are located and hidden from sight with the wrench in its assembled condition. Each of the notches defining the positioning surfaces 56 has a V shape illustrated in FIGS. 5 and 6 and is oriented to open away from the pawl axis B toward the spring biaser 44.

As illustrated in FIGS. 5 and 6, the spring biaser 44 includes a ball 60 and a spring 62 that biases the ball against the notches 56 of the pawl 38 to provide the overcenter positioning of the pawl. The head 12 of the wrench body includes a hole 64 that extends from the pawl portion 24 of opening 20 toward the handle of the wrench. Spring 62 is of the helical type and has one end seated by the hole 64 and has another end that seats the ball 60 to provide biasing of the ball toward the pawl 38 in order to provide the overcenter positioning of the pawl. It will be noted in FIG. 3 that the hole 64 is preferably drilled at an angle such that a straight drilling operation can be used.

While the best mode for carrying out the invention has been described in detail, those familiar with the art to which this invention relates will recognize various alternative designs and embodiments for practicing the invention as defined by the following claims.

What is claimed is:

1. A reversible ratchet wrench comprising; a wrench body including a unitary head and a handle extending from the head; said unitary head having oppositely facing planar surfaces and an opening extending therebetween; said oppositely facing planar surfaces defining the maximum thickness of the wrench head of the body; the opening having circular driver and pawl portions that overlap each other; a driver having a round ratchet portion received within the circular driver portion of the head opening and supported for rotation about a driving axis; said ratchet portion of the driver having teeth that extend continuously without interruption between the oppositely facing planar surfaces of the head; the driver also including a driving portion; a generally round pawl received within the pawl portion of the opening and supported for rotation about a pawl axis; said pawl having oppositely facing planar surfaces and also having spaced teeth for selectively engaging the teeth of the ratchet portion of the driver to prevent rotation thereof with respect to the head in one direction or the other depending upon the pawl position; said pawl teeth extending continuously without interruption between the oppositely facing planar surfaces of the head to provide continuous uninterrupted engagement thereof with the teeth on the ratchet portion of the driver; the pawl having a tab for providing rotation thereof to change the direction of locking the driver against rotation; the driver including a flange having a planar surface that engages one planar surface of the head and directly engages one planar surface of the pawl; a retainer on the driver; said retainer having a planar surface for engaging the other planar surface of the head and for directly engaging the other planar surface of the pawl such that the driver flange and the retainer cooperate to retain both the driver and the pawl on the head within the opening; and means for maintaining the pawl teeth in engagement with the ratchet teeth on the driver to prevent rotation thereof in one direction or the other while permitting rotation of the driver in the opposite direction by ratcheting of the pawl.

2. A ratchet wrench as in claim 1 wherein the head of the wrench body and the handle of the wrench are unitary with each other, the driver portion of the opening through the head having a larger size than the pawl portion of the opening, and the pawl and tab having a unitary construction.

3. A ratchet wrench as in claim 1 or 2 wherein said means comprises a spring biaser, the pawl including a pair of positioning surfaces against which the spring biaser acts to provide overcenter positioning of the pawl, and the pawl having spaced skirts between which the positioning surfaces are located and hidden from sight.

4. A ratchet wrench as in claim 3 wherein the pawl includes a pair of notches which define the positioning surfaces.

5. A ratchet wrench as in claim 3 wherein the spring biaser includes a ball and a spring that biases the ball against the positioning surfaces of the pawl to provide the overcenter positioning of the pawl.

6. A ratchet wrench as in claim 5 wherein the head of the wrench body includes a hole that extends from the pawl portion of the opening toward the handle, the spring being of the helical type having one end seated by the hole, and the spring having another end that seats the ball to provide biasing thereof toward the pawl.

7. A ratchet wrench as in claim 6 wherein the circular driver and pawl portions of the opening have cylindrical shapes extending between the oppositely facing surfaces of the head.

8. A reversible ratchet wrench comprising: a wrench body including a unitary head and a handle extending from the head; said head having oppositely facing planar surfaces and an opening extending therebetween;

the opening having circular driver and pawl portions that overlap each other and have cylindrical shapes extending between the oppositely facing planar surfaces of the head; a driver having a round ratchet portion received within the circular driver portion of the head opening and supported for rotation about a driving axis; said ratchet portion of the driver having teeth spaced about the driving axis; the driver including a driving portion; a pair of planar retaining surfaces on the driver for engaging the oppositely facing planar surfaces of the head to retain the driver on the head; a generally round pawl received within the pawl portion of the opening and supported for rotation about a pawl axis; said pawl having oppositely facing planar surfaces; said planar retaining surfaces on the driver directly engaging the oppositely facing planar surfaces of the pawl to cooperate in retaining the pawl within the pawl portion of the opening; said pawl having spaced teeth for selectively engaging the teeth of the ratchet portion of the driver to prevent rotation thereof with respect to the head in one direction or the other depending upon the pawl position; the pawl having a tab for providing rotation thereof to change the direction of locking the driver against rotation; and a spring biaser for maintaining the pawl teeth in engagement with the ratchet teeth on the driver to prevent rotation thereof in one direction or the other while permitting rotation of the driver in the opposite direction by ratcheting of the pawl.

9. A ratchet wrench as in claim 8 wherein the driver includes a flange defining one of the planar retaining surfaces and also includes a retainer that defines the other planar retaining surface.

10. A ratchet wrench as in claim 9 wherein the driving portion comprises a driving lug that projects outwardly past the surface of the head engaged by the retaining surface of the retainer.

11. A ratchet wrench as in claim 8 wherein the head of the wrench body and the handle of the wrench are unitary with each other, the driver portion of the opening through the head having a larger size than the pawl portion of the opening, and the pawl and tab having a unitary construction.

12. A ratchet wrench as in claim 8, 9, 10 or 11 wherein said means comprises a spring biaser, the pawl including a pair of positioning surfaces against which the spring biaser acts to provide overcenter positioning of the pawl, and the pawl having spaced skirts between which the positioning surfaces are located and hidden from sight.

13. A ratchet wrench as in claim 12 wherein the pawl includes a pair of notches which define the positioning surfaces.

14. A ratchet wrench as in claim 12 wherein the spring biaser includes a ball and a spring that biases the ball against the positioning surfaces of the pawl to provide the overcenter positioning of the pawl.

15. A ratchet wrench as in claim 14 wherein the head of the wrench body includes a hole that extends from the pawl portion of the opening toward the handle, the spring being of the helical type having one end seated by the hole, and the spring having another end that seats the ball to provide biasing thereof toward the pawl.

16. A ratchet wrench as in claim 14 wherein the teeth of the ratchet portion of the driver and the teeth of the pawl extend between the oppositely facing surfaces of the head.

17. A reversible ratchet wrench comprising: a wrench body including a unitary head and handle; said head having oppositely facing planar surfaces and an opening extending therebetween; the opening having circular driver and pawl portions that overlap each other and have cylindrical shapes extending between the oppositely facing planar surfaces of the head; the driver portion of the opening having a larger size than the pawl portion of the opening; a driver having a round ratchet portion received within the circular driver portion of the head opening and supported for rotation about a driving axis; said ratchet portion of the driver having teeth that are spaced about the driving axis and extend continuously without interruption between the oppositely facing planar surfaces of the head; the driver including a driving lug and also including a flange having a planar retaining surface that engages one planar surface of the head; a retainer on the driver; said retainer having a planar retaining surface for engaging the other planar surface of the head to cooperate with the flange in retaining the driver on the head; said driving lug projecting along the driving axis outwardly past said other planar surface of the head; a generally round pawl received within the pawl portion of the opening and supported for rotation about a pawl axis; said pawl having oppositely facing planar surfaces; said planar retaining surface on the flange of the driver and the planar retaining surface on the retainer of the driver directly engaging the oppositely facing planar surfaces of the pawl to cooperate in retaining the pawl within the pawl portion of the opening; said pawl having spaced teeth that extend continuously without interruption between the oppositely facing planar surfaces of the head to selectively engage the teeth of the ratchet portion of the driver to prevent rotation thereof with respect to the head in one direction or the other depending upon the pawl position; the pawl having a tab for providing rotation thereof to change the direction of locking the driver against rotation; the pawl including a pair of positioning surfaces spaced about the pawl; and an overcenter spring biaser including a ball and a spring that biases the ball against the positioning surfaces of the pawl to position the pawl in order to maintain the pawl teeth in engagement with the ratchet teeth on the driver to prevent rotation of the driver in the opposite direction by ratcheting of the pawl.

* * * * *